United States Patent [19]

Guthrie et al.

[11] 4,123,231

[45] Oct. 31, 1978

[54] CLEAR, BRIGHT OIL-SOLUBLE ALUMINUM-CONTAINING COMPOSITIONS

[75] Inventors: David B. Guthrie; Donald M. Leiendecker, both of St. Louis, Mo.

[73] Assignee: Petrolite Corporation, St. Louis, Mo.

[21] Appl. No.: 765,725

[22] Filed: Feb. 4, 1977

[51] Int. Cl.[2] ..... C10L 1/10; C10M 1/10; C10L 1/12

[52] U.S. Cl. ..... 44/51; 252/309

[58] Field of Search ..... 44/51; 252/309, 352, 252/33, 334, 49

[56] References Cited

U.S. PATENT DOCUMENTS

| | | | |
|---|---|---|---|
| 3,018,172 | 1/1962 | Tillman | 44/51 |
| 3,031,418 | 4/1962 | Bugosh | 252/309 |
| 3,867,296 | 2/1975 | Hunt | 44/51 |

*Primary Examiner*—Allen B. Curtis
*Assistant Examiner*—Raymond Covington
*Attorney, Agent, or Firm*—Sidney B. Ring; Hyman F. Glass

[57] ABSTRACT

This invention relates to the preparation of clear, bright oil-soluble aluminum-containing compositions of high aluminum content; to the resulting products; and to the use of such products; for example, as fuel additives such as additives employed in turbine fuels as corrosion inhibitors and other uses.

11 Claims, No Drawings

CLEAR, BRIGHT OIL-SOLUBLE ALUMINUM-CONTAINING COMPOSITIONS

Oil-soluble aluminum-containing compositions have been prepared by a wide variety of methods. One method is described in U.S. Pat. No. 3,867,296 which is summarized in claim 1 thereof as follows:

A process for preparing clear, bright aluminum-containing dispersions containing at least 6 weight percent aluminum, said process comprising:

a. admixing an oil soluble dispersing agent, selected from the group consisting of oil soluble sulfonic acids in which the hydrocarbon portion has a molecular weight between about 350 and 1000 and hydrocarbyl carboxylic acids containing at least 8 carbon atoms, an oleaginous carrier selected from the group consisting of mineral lubricating oils, synthetic lubricating oils, vegetable oils and animal oils and a volatile hydrocarbon solvent having a boiling point at atmospheric pressure below about 300° F. with alumina prepared by the water hydrolysis of aluminum alkoxides and having the following properties:

(1) Crystal structure — alpha alumina monohydrate
(2) Crystal structure after calcining to 900° F — gamma alumina
(3) Ultimate crystal size (X-ray diffraction)
020 reflection: 30–70A
021 reflection: 60–110A
(4) Pore volume: 0.35–0.65 cc/g
(5) Loose bulk density: 35–70 lb/ft$^3$
(6) Particle size (sieve)
> 45 micron — 20%
< 45 micron — 80%
(7) $Al_2O_3$ content: 65–85 wt. %
(8) Loss on Ignition: 15–35 wt. %
(9) Surface Area: 150–350 m$^2$/g to form a mixture of uniform consistency;

b. heating said mixture to remove substantially all of said volatile hydrocarbon solvent and c. recovering said clear, bright aluminum-containing dispersion.

One of the problems in the preparation of clear, bright water-free oil-soluble aluminum-containing compositions of U.S. Pat. No. 3,867,296, particularly at high aluminum concentrations such as in the 20% aluminum content range, is the presence of oil insoluble residues in the product. Such high aluminum-containing compositions must then be subjected to the difficult and expensive steps of filtration or centrifugation to make them clear and bright.

We have now discovered that by employing aqueous mineral acids having monovalent anions in the process that substantially no (i.e., little, if any) residue remains in the water-free product, even at high concentrations of aluminum. As a result no filtration or centrifugation is required to obtain a clear, bright product. This has been unobtainable by prior art methods as expressed in U.S. Pat. No. 3,867,296, column 5, lines 46–52, which states: "In many applications it may be desirable to add an excess of alumina to achieve maximum dispersion of alumina in the end product. In such instances it would be desirable to use the filtration step to obtain the clear, bright product. The alumina dispersions so produced contain up to about 20% weight percent aluminum."

In contrast, the present process yields 20 wgt. percent aluminum solutions or greater without employing filtration or centrifugation which product contains little, if any, residue.

In general our process is carried out by heating a mixture of an organic sulfonic acid, solvent, aqueous mineral acid and alumina. During the heating, water is removed from the mixture by distilling an azeotropic mixture of water and aromatic solvent into a Dean-Stark Trap while returning the upper solvent layer to maintain the desired 20% minimum aluminum concentration. However, it is obvious that more solvent can be used during processing but that it must be removed by distillation to achieve an aluminum content at 20%, minimum. Preferably, a solvent mixture of aromatic hydrocarbons and kerosene is employed in the process. Substantially no residual solids are present in the water-free product, i.e., less than 0.50% by volume, as determined by a centrifugation test and preferably less than 0.40%.

The present invention differs from U.S. Pat. No. 3,867,296 as follows:

1. Fatty carboxylic acids are not used in the present invention;

2. Simple alkyl (dodecyl) benzene sulfonic acid is used in the present invention rather than higher molecular weight sulfonic acids of U.S. Pat. No. 3,867,296;

3. An aqueous mineral acid having a monovalent anion is required to effect a virtually complete dispersion of alumina in a water-hydrocarbon-sulfonic acid-mineral acid mixture before the product is isolated in the water-free hydrocarbon solvent (The use of an emulsion breaker such as isopropyl alcohol at a minimal concentration is optional during the formation of the preliminary dispersion.);

4. The use of high flash point solvents for both process and product is superior to the need for low flash point solvents used in the above-mentioned patent, i.e., below 300° F (149° C) such as $C_6$ or less alcohols, hexane, benzene, etc., which must be removed before marketing; the preferred aromatic solvents of this invention are above 300° F (i.e., 155°–165° C);

5. The water-free product of this invention at 20% aluminum content does not require clarification by filtration or centrifugation whereas the product at 20% aluminum content by the above-mentioned patent (see Column 5, lines 46–52) requires a filtration step;

6. This invention achieves a substantially higher over-based product as compared to the over-basing in the prior art patent by a factor of at least 2;

7. No mineral lubricating oil, synthetic lubricating oils, vegetable oils or animal oils are required in the present invention.

The dispersible alumina useful in the process of the present invention is prepared by the water hydrolysis of aluminum alkoxides prepared by the Ziegler process to produce an organic portion and an alumina slurry portion. The alumina slurry portion is further purified and dried. Careful control of this process results in alumina which can be used to prepare the oil soluble dispersions of the present invention. Such an alumina is marketed by Philadelphia Quartz Company of Valley Forge, Pa. under the "DISPAL" trademark of Continental Oil Company. The properties of such alumina are typically as follows:

Typical Chemical Composition

Alpha alumina monohydrate (Boehmite): 90%
Water: 9%
Carbon (as primary alcohol): 0.5%
$SiO_2$: 0.008%
$Fe_2O_3$: 0.005%

$Na_2O$: 0.004%
S: 0.005%

Typical Physical Properties

Surface Area: 320 $m^2$/gm.
Particle size:
a. Powder, by sieving:
> 45 micron: 15%
< 45 micron: 85%
b. Dispersion-by x-ray diffraction: 0.0048 micron
Loose Bulk Density: 45 lbs/$ft^3$
Packed Bulk Density: 50 lbs/$ft^3$ It has been found that uniquely desirable aluminum dispersions are produced by the process of the present invention when such alumina is used. Tests with other alumina products have yet to yield comparable products.

In contrast to U.S. Pat. No. 3,867,296 where "oil-soluble sulfonic acids" are defined as "those materials wherein the hydrocarbon portion of the molecule has a molecular weight in the range of about 300 to about 1000, preferably, this molecular weight is in the range of about 370 to about 700" the preferred sulfonates of the present invention have a hydrocarbon portion whose molecular weight is below 300. For example, the preferred sulfonate, dodecylbenzene sulfonic acid, has a hydrocarbon portion having a molecular weight of 245 which is below the minimum values stated in U.S. Pat. No. 3,867,296. However, other sulfonic acids, including petroleum sulfonic acids may be used.

Examples of hydrocarbon groups (R) of other sulfonic acids

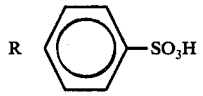

include alkyl, aryl, alkaryl, aralkyl, cycloalkyl, etc. groups, as illustrated by the following specific examples:
Octyl
decyl
tetradecyl
hexadecyl
octadecyl
and corresponding sulfonates where the phenyl group is naphthyl, etc.

Solvents for the process and products as used herein include hydrocarbon solvents having a boiling point at normal atmospheric pressure of at least about 300° F and a flash point of at least 100° F. Some specific examples of such very desirable solvents are:
trimethyl benzenes
methyl ethyl benzenes
propyl benzenes, and
kerosene.

Any suitable mineral acid having a monovalent anion can be employed such as $HNO_3$, HCl, HBr, HI, HF, or the salts of weak bases thereof such as $AlCl_3$, $Al(NO_3)_3$. $NH_4NO_3$, $NH_4Cl$, $BF_3$ or mixtures thereof.

The amount of mineral acid equivalent employed in the process is from about 0.001 to 1.5 parts by weight acid per part by wgt. of alumina, such as from about 0.005 to 1.0 parts, for example from about 0.010 to 0.50 but preferably from about 0.015 to 0.10.

The amount of added water (i.e., not already in the alumina used) employed in this process is from about zero to 10.0 parts by weight of water per part by weight of alumina, such as from about zero to 7.5, for example from about zero to 5.0, but preferably from about zero to 4.6.

The following examples are presented by way of illustration and not of limitation.

EXAMPLE 1

To a beaker with the stirrer on, are charged 575g tap water, 11.0g concentrated hydrochloric acid and 170g Dispal M alumina (at 40% Al content), and the mixture is allowed to stir for about 6 hours. This mixture is charged with stirring to a 2-liter, three-necked reaction flask containing 55.1g dodecylbenzene sulfonic acid (equivalent weight at about 318) and 363g aromatic solvent (boiling point about 155° C). Three drops of antifoam are added. The contents of the flask are heated in an oil bath until a co-distillation of aromatic solvent and water begins. The distillate is condensed and allowed to collect in a Dean-Stark Trap from which the upper aromatic solvent layer is returned to the reactor and the lower water layer is periodically removed. Separation of water is made by co-distillation until all the water has been removed. The product in the reactor is bright; the net weight is 571g with an aluminum content calculated at 12%; the undispersed solids as measured by a centrifugation test is less than 0.25% by volume. The aluminum content is increased to 20% by a distillation to remove solvent.

EXAMPLE 2

To a 1000-ml reactor fitted with agitator and thermometer are charged 108g of dodecylbenzene sulfonic acid (equivalent weight of 303–320), 200g aromatic solvent (boiling point about 155°-165° C), 100g kerosene, 6g isopropanol, 150g water, and 9g of 70% nitric acid. The mixture is allowed to stir for 15 minutes while heating to 55° C. Then 340g of Dispal M alumina is added to the acid-solvent mass at 55°–65° C. The resulting mixture is heated for 1½ to 2 hours at 65°–96° C. Water is removed by co-distillation with the aromatic solvent using a Dean-Stark Trap for phase separation and for return of aromatic solvent to the reactor. When the reactor temperature reaches 110° C, reduced pressure is applied slowly to complete the removal of water. The product is a bright, red-black color weighing 702g, with an aluminum content of 20%; the undispersed solids as measured by a centrifugation test is less than 0.25% by volume.

EXAMPLE 3

To a 10-gallon stainless steel reactor are charged 8.0 lbs of dodecylbenzene sulfonic acid, 14.75 lbs of aromatic solvent, 7.375 lbs kerosene, 0.875 lbs isopropanol, 11.0 lbs water, and 0.75 lbs of 70% nitric acid. With the reactor closed, this mixture is allowed to stir while heating to 65° C during a 20-minute period. The reactor is opened, and 25.0 lbs of Dispal M is added to the acid-solvent mass. After all the Dispal M is in, the reactor is closed, and the contents are heated from 65°–96° C over 1½ to 2 hours. The riser valve is opened to the condenser and decanter and return line. Water is removed by co-distillation with the aromatic solvent, which is allowed to return to the reactor. After the reactor temperature reaches 110° C, reduced pressure is applied slowly to remove the remainder of the water in the reaction mass. The product is a dark, red-black bright material weighing 51.0 lbs with an aluminum content at 20%; the undispersed solids as measured by a centrifugation test is 0.025% by volume.

EXAMPLE 4

To a 100-gallon glassteel reactor are charged 83.375 lbs. of dodecylbenzene sulfonic acid, 147.875 lbs of aromatic solvent, 69.75 lbs kerosene, 9.375 lbs isopropanol, 110.5 lbs water, and 8.375 lbs of 70% nitric acid. With the reactor closed, this mixture is allowed to stir while heating to 55°–65° C for 15 minutes. The reactor is opened, and 255.5 lbs of Dispal M is added to the acid-solvent mass. After all the Dispal M is in, the reactor is closed and heated from 65°–90° C over 1½ to 2 hours. The riser valve is opened to the condenser and decanter and return line. Water is removed by co-distillation with the aromatic solvent, which is allowed to return to the reactor. After the reactor temperature reaches 110° C, reduced pressure is applied slowly to remove the remainder of the water in the reaction mass. The product is a dark, red-black bright material weighing 515 lbs with an aluminum content at 20%; the undispersed solids as measured by a centrifugation test is 0.25% by volume.

EXAMPLE 5

To a 500-ml glass reaction flask is charged 21.6g dodecylbenzenesulfonic acid, 40.0g aromatic solvent (b.p. at about 155° C), 20.0 kerosene, 1.2g isopropyl alcohol, and 3.4g concentrated hydrochloric acid. This mixture is allowed to stir at 25°–30° C. Dispal M alumina (68g) is charged through a powder funnel. A Dean-Stark Trap and condenser is attached. The mixture is heated to effect distillation of water and solvent. The water layer is separated in the trap with the upper solvent layer returning to the reaction flask. The last traces of water are removed by subjecting the system to reduced pressure. The weight of water-free bright product is 132.0g for a calculated 20.6% aluminum content. The amount of insoluble gel as determined by a centrifugation test was 0.37%.

EXAMPLE 6

Example 5 was repeated except that 30.0g of water was added prior to the charge of concentrated hydrochloric acid. The weight of water-free bright product was 136.1g for a calculated 20.0% aluminum content. The amount of insoluble gel as determined by a centrifugation test was 0.32%.

The aluminum dispersions as produced by the process of the present invention require no further clarification and are formulated into useful fuel oil additives, jet fuel additives, motor fuel additives, lubricant additives and the like. The dispersions of the present invention are particularly useful since such dispersions contain substantial amounts of aluminum in a clear, bright dispersion suitable for use in high quality motor oils and the like.

The compositions of this invention are particularly effective in the inhibition of vanadium corrosion in gas turbines.

We claim:

1. A process for preparing clear, bright, water-free, high aluminum-containing dispersions in hydrocarbons at at least about 20% aluminum content which is characterized by the step of dispersing alumina powder, prepared by the water hydrolysis of aluminum alkoxides, with an oil soluble sulfonic acid in a hydrocarbon solvent in the presence of aqueous mineral acid the anion of which is monovalent or salts thereof capable of generating said mineral acid in situ, said monovalent mineral acid being so selected and present in an amount sufficient to obtain the water-free dispersion substantially free of residues.

2. The process of claim 1 where the water-free product contains substantially no residue and is used without further clarification.

3. The process of claim 2 where the oil soluble sulfonic acid is an oil soluble hydrocarbon sulfonic acid where the hydrocarbon group of the oil soluble sulfonic acid has a molecular weight of less than 300.

4. The process of claim 3 where the oil soluble sulfonic acid is dodecylbenzene sulfonic acid.

5. The process of claim 3 where the mineral acid is nitric acid, hydrochloric acid, or mixtures thereof.

6. The process of claim 4 where the mineral acid is nitric acid, hydrochloric acid or mixtures thereof.

7. The process of claim 3 where the mineral acid content is obtained from a salt.

8. The process of claim 6 where the hydrocarbon solvent has a boiling point at normal atmospheric pressure of at least about 300° F. and a flash point of at least 100° F.

9. The process of claim 8 where the hydrocarbon solvent includes an aromatic solvent, the amount of mineral acid is 0.001 to 1.5 parts by weight acid per part by weight of alumina; the mixture of the named materials is heated during the dispersing step, and water is distilled from the mixture and solvent is distilled to the extent necessary to achieve 20% aluminum content.

10. The process of claim 9 where the alumina powder has the following properties:

Typical Chemical Composition

Alpha alumina monohydrate (Boehmite): 90%
Water: 9%
Carbon (as primary alcohol): 0.5%
$SiO_2$: 0.008%
$Fe_2O_3$: 0.005%
$Na_2O$: 0.004%
S: 0.005%

Typical Physical Properties

Surface Area: 320 $m^2$/gm.
Particle size:
a. Powder, by sieving:
$>$ 45 micron: 15%
$<$ 45 micron: 85%
b. Dispersion-by X-ray diffraction: 0.0048 micron
Loose Bulk Density: 45 lbs/$ft^3$
Packed Bulk Density: 50 lbs/$ft^3$.

11. The process of claim 10 wherein the sole organic materials used in the preparation of the alumina dispersion are an oil soluble sulfonic acid, an aromatic hydrocarbon solvent of B.P. about 155°–165° C., and, as optional materials, kerosene and isopropyl alcohol.

* * * * *